US005445122A

United States Patent [19]

Gerhard et al.

[11] Patent Number: 5,445,122

[45] Date of Patent: Aug. 29, 1995

[54] IGNITION SYSTEM FOR INTERNAL COMBUSTION ENGINES WITH DUAL IGNITION

[75] Inventors: Albert Gerhard, Tamm; Dieter Betz, Vaihingen; Walter Streit, Ingolstadt, all of Germany

[73] Assignee: Robert Bosch GmbH, Stuttgart, Germany

[21] Appl. No.: 231,078

[22] Filed: Apr. 22, 1994

[30] Foreign Application Priority Data

Apr. 22, 1993 [DE] Germany ..... 43 13 172.7

[51] Int. Cl.[6] ..... F02P 15/02; F02P 15/08

[52] U.S. Cl. ..... 123/310; 123/638; 123/643

[58] Field of Search ..... 123/310, 638, 640, 643

[56] References Cited

U.S. PATENT DOCUMENTS 3,910,247 10/1975 Hartig ..... 123/643
4,953,519 9/1990 Hoeptner, III ..... 123/638 X

FOREIGN PATENT DOCUMENTS 0200196 11/1986 European Pat. Off. .
1481169 7/1977 United Kingdom ..... 123/638

*Primary Examiner*—Tony M. Argenbright
*Attorney, Agent, or Firm*—Kenyon & Kenyon

[57] ABSTRACT

An ignition system for internal combustion engines has two spark plugs per cylinder. The spark plugs are connected in a parallel circuit with the same end of an ignition coil.

8 Claims, 1 Drawing Sheet

IGNITION SYSTEM FOR INTERNAL COMBUSTION ENGINES WITH DUAL IGNITION

BACKGROUND OF THE INVENTION

An ignition system with dual spark coils is known from European Patent Application No. EP 0 200 196 A2, wherein a spark plug is associated with each end of a secondary winding. The number of ignition coils is equal to the number of cylinders, since two spark plugs are associated with each cylinder and these spark plugs are attached to different ignition coils. As a result, the ignition coils must be controlled simultaneously in pairs. Hence, two ignition coil is are controlled to ignite the mixture in the prior art, so that the spark plugs located in the cylinder in question are triggered. The two spark plugs connected at the other end of the secondary winding of the two dual spark coils must be arranged so that this cylinder is in the exhaust stroke and hence does not undergo ignition, since it does not contain an ignitable mixture. This design of an ignition system with dual spark coils, however, has the disadvantage that an equal number of spark plugs and cylinders is required. In addition, the number of end stages must correspond to the number of cylinders, which increases the cost of the circuit.

In addition, in this ignition system a relatively large expenditure is required to control the individual end stages.

Similarly, ignition systems for dual ignition are known in which an individual ignition coil is associated with each spark plug, so that the number of ignition coils and end stages is twice the number of cylinders. It is also possible to equip ignition systems for dual ignition with rotary distribution, for example with two ignition coils and with two distributors. In this case, the high mechanical expense is particularly disadvantageous.

SUMMARY OF THE INVENTION

In accordance with the present invention, an ignition system with dual ignition, i.e. two spark plugs and hence two ignition sparks in one cylinder, utilizes only half as many ignition coils as cylinders. This reduces the number of end stages and ignition coils required in contrast to the prior art. Moreover, as a result of halving the cost of the end stages, the cost of the control device to control the individual end stages decreases as well. Furthermore, the present invention is equally applicable to dual ignition systems with rotary distribution of high voltage and to systems with individual ignition coils, i.e., one ignition coil per spark plug or per cylinder. This also reduces the cost of ignition coils, end stages, and possibly ignition distributors to half that required for a conventional ignition.

In accordance with an embodiment of the present invention, a balancing element is provided which, when a current divider choke is used, ensures that after the current begins to flow in a spark plug, an additional voltage pulse is generated which leads to sparkover at the second spark plug and hence causes the current to flow. This balancing element balances the ignition currents in both spark plugs until the end of the discharge.

In accordance with a further embodiment of the present invention, a current dividing choke is used as the balancing element. The current dividing choke can be mounted, for example, directly on the individual cylinders. This reduces the number of secondary connections and makes it possible to keep losses low.

In ignition systems with rotary distribution, locating the distributor between the high-voltage terminal and the balancing element can reduce the number of ignition coils and simultaneously take advantage of the effect of the balancing element which generates an additional voltage pulse after the current begins to flow at a spark plug.

Finally, triggering two ignition sparks in one ignitable cylinder reduces the possibility of backfire, and hence the expulsion of unburned mixture can be avoided.

DETAILED DESCRIPTION OF THE INVENTION

Figure 1:
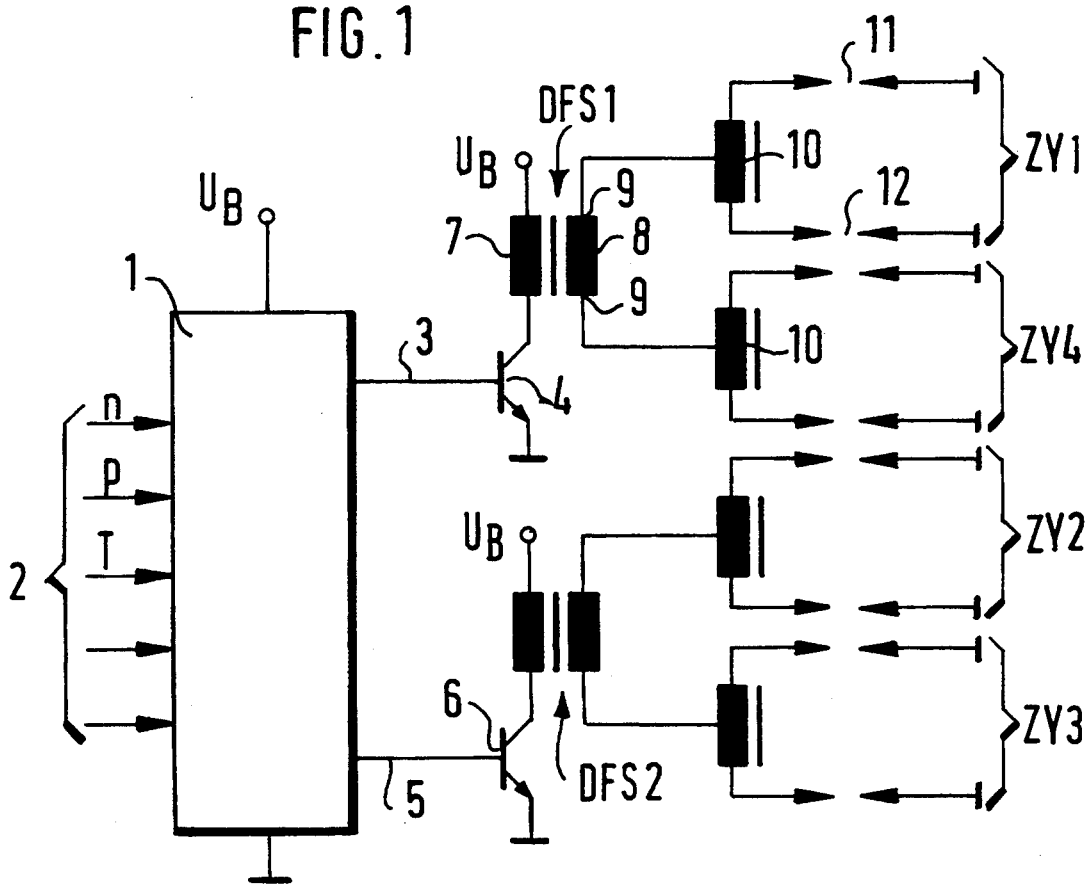
FIG. 1 shows an ignition system according to the present invention for a four-cylinder internal combustion engine.

Referring to FIG. 1, an ignition system for an internal combustion engine according to the present invention is shown which includes a control device 1 to which various operating parameters 2, for example rpm n, pressure p, or temperature T are supplied to control the ignition. Control device 1 is connected by a link 3 with the control electrode of ignition transistor 4 and through a link 5 with the control electrode of ignition transistor 6, Depending upon the operating parameters 2 received, control device 1 calculates the ignition time and dwell angle for the individual cylinders. On this basis, the control signals are supplied and the current flow is switched on and off in the first dual ignition coil DFS1 and the second dual ignition coil DFS2. Dual ignition coil DFS1 includes a primary winding 7 and a secondary winding 8.

A current divider choke 10 is associated with each end 9 of secondary winding 8, to each end of which choke a spark plug 11 or spark plug 12 is in turn connected. Hence, each end 9 of secondary winding 8 leads to two spark plugs 11 and 12, said spark plugs being connected in parallel and located in a cylinder ZY1. The arrangement of the two ends 9 of a secondary winding, in other words the high-voltage connections, are made in the conventional fashion so that the functional and reinforcing sparks are produced in phase.

Control device 1 calculates, as a function of the operating parameters received, the spark timing and dwell angle for the individual cylinders. On the basis of these calculated signals, a control signal is output to the bases of the respective ignition transistors 4 or 6. As a result, the current begins flowing in primary winding 7 (for the sake of simplicity, only the action in cylinder 1 ZY1 will be described). With the calculated spark timing, the flow of current in primary winding 7 of dual ignition coil DFS1 is interrupted. This causes a high voltage to be induced on the secondary side which then for example creates a functional spark in cylinder 1 and a reinforcing spark in cylinder 4. Cylinder 4 is then in the exhaust stroke, so that this reinforcing spark has no effect.

Balancing element 10 in cylinder 1 ensures that after the current begins flowing in first spark plug 11, an additional voltage pulse is generated in the magnetically coupled transmitter (current divider choke 10), which causes sparkover in the second spark plug as well and hence causes the current to flow. After both spark plugs have been triggered, this magnetically coupled transmitter balances the ignition currents in the two spark plugs until the end of the discharge. In this case the winding ratio is 1. With a number-of-windings ratio which differs from 1 for the balancing element, within certain limits, different ignition currents can be set for the two spark plugs. This can be utilized for improved adaption of the ignition system to the conditions in the engine combustion chamber.

Figure 2:
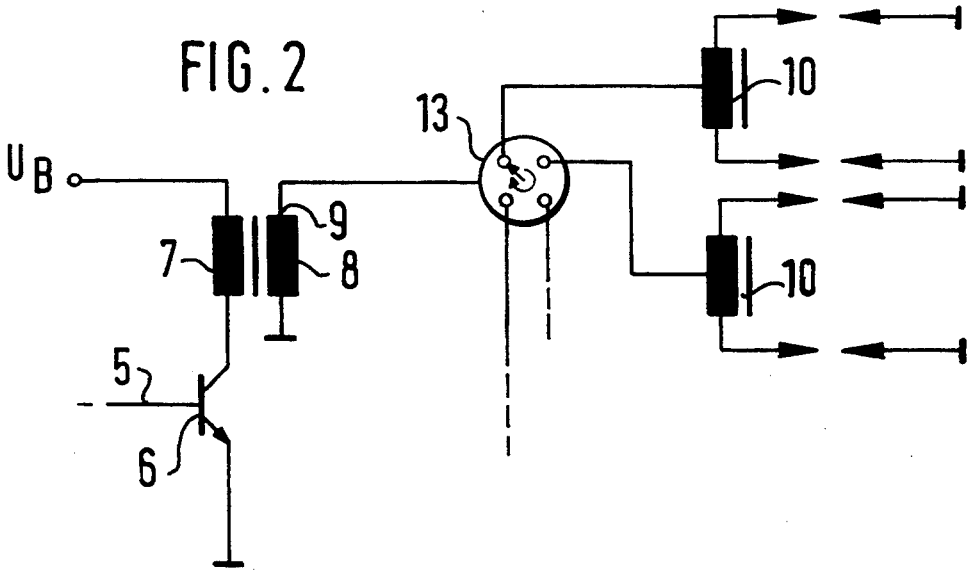
FIG. 2 shows an ignition system according to the present invention including rotary high-voltage distribution.

FIG. 2 shows a system according to the present invention for ignition systems with rotary high-voltage distribution. Identical reference numerals are used for components which are the same, and the operation likewise corresponds to FIG. 1. In accordance with the system of FIG. 2, however, a distributor 13 is connected to the high voltage end 9 of secondary winding 8. The distributor rotor thus distributes the energy to the individual cylinders, with each distributor contact being connected through balancing element 10 with the respective two spark plugs of a cylinder.

In addition, the system according to the present invention can also be used with individual spark plugs with the high-voltage distribution at rest. In individual coils, at the end of the secondary winding, and therefore at the high-voltage output of the ignition coil, two spark plugs are connected in parallel with the balancing element between them, the plugs projecting into the same cylinder.

What is claimed is:

1. An ignition system for an internal combustion engine, the ignition system comprising:

at least one ignition coil;

a plurality of cylinders, at least one of the plurality of cylinders associated with at least one end of a secondary winding of the at least one ignition coil;

a balancing element coupled to the at least one end of the secondary winding of the at least one ignition coil; and at least two spark plugs associated with the at least one of the plurality of cylinders, the balancing element being coupled between the at least two spark plugs.

2. The ignition system according to claim 1, wherein the balancing element includes a current divider choke.

3. The ignition system according to claim 1, wherein the ignition coil is a dual spark coil, and wherein a first pair of the at least two spark plugs, in a first cylinder of the plurality of cylinders, is associated with a first end of the secondary winding of the dual spark coil and a second pair of the at least two spark plugs, in a second cylinder of the plurality of cylinders, is associated with a second end of the secondary winding of the dual spark coil.

4. The ignition system according to claim 1, wherein the at least one ignition coil is an individual coil, and wherein one of the at least one ignition coils is associated with each of the plurality of cylinders.

5. The ignition system according to claim 1, further comprising an ignition distributor coupled between a high-voltage connection of the at least one ignition coil and the balancing element.

6. The ignition system according to claim 3, wherein each of the first pair of the at least two spark plugs triggers a functional spark in the first cylinder of the plurality of cylinders, and each of the second pair of the at least two spark plugs simultaneously triggers a reinforcing spark in the second cylinder of the plurality of cylinders.

7. The ignition system according to claim 1, wherein the balancing element is mounted directly on the at least one of the plurality of cylinders.

8. The ignition system according to claim 1, wherein the at least two spark plugs are coupled in parallel.

* * * * *